US012274400B2

(12) United States Patent
Brazelton

(10) Patent No.: US 12,274,400 B2
(45) **Date of Patent: *Apr. 15, 2025**

(54) ROTATABLE TOILET PAPER HOLDER DEVICE

(71) Applicant: Jeff Brazelton, Hemet, CA (US)

(72) Inventor: Jeff Brazelton, Hemet, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/443,388

(22) Filed: Feb. 16, 2024

(65) Prior Publication Data

US 2024/0225377 A1 Jul. 11, 2024

Related U.S. Application Data

(63) Continuation of application No. 17/591,194, filed on Feb. 2, 2022, now Pat. No. 11,937,742.

(60) Provisional application No. 63/287,571, filed on Dec. 9, 2021.

(51) Int. Cl.
*A47K 10/38* (2006.01)
*A47K 10/32* (2006.01)

(52) U.S. Cl.
CPC ..... *A47K 10/38* (2013.01); *A47K 2010/3233* (2013.01)

(58) Field of Classification Search
CPC ..... A47K 10/38
See application file for complete search history.

(56) References Cited

U.S. PATENT DOCUMENTS

| | | | | |
|---|---|---|---|---|
| 4,606,510 | A * | 8/1986 | McEntire | A47K 10/38 242/560.3 |
| 6,273,359 | B1 * | 8/2001 | Newman | A47K 10/32 242/615.4 |
| 11,937,742 | B2 * | 3/2024 | Brazelton | A47K 10/3836 |
| 2005/0056722 | A1 * | 3/2005 | Laurence | B65H 16/06 242/598.6 |

* cited by examiner

*Primary Examiner* — Gene O Crawford
*Assistant Examiner* — Ayodeji T Ojofeitimi
(74) *Attorney, Agent, or Firm* — Brennan, Manna & Diamond, LLC

(57) ABSTRACT

The present invention relates to a rotatable toilet paper holder device primarily comprised of at least two side walls, a bottom wall, a base and a toilet paper roll holder. The toilet paper roll holder is spring-loaded, such that a toilet paper roll can be secured between the side walls of the device. The side walls and bottom wall further attach to the base via at least one fastener that allows the side walls and bottom wall to rotate around the base. Therefore, a toilet paper roll that is secured between the side walls via the toilet paper roll holder can be easily rotated relative to the base, such that the toilet paper within the device can be positioned so that toilet paper can be pulled from over top or from under the toilet paper roll.

4 Claims, 4 Drawing Sheets

ROTATABLE TOILET PAPER HOLDER DEVICE

CROSS-REFERENCE TO RELATED APPLICATION

The present application is a continuation of, and claims priority to and the benefit of, U.S. patent application Ser. No. 17/591,194, which was filed on Feb. 2, 2022 and claims priority from U.S. Provisional Application No. 63/287,571, which was filed on Dec. 9, 2021, both of which are incorporated herein by reference in their entirety.

FIELD OF THE INVENTION

The present invention relates generally to the field of toilet paper holders. More specifically, the present invention relates to a rotatable toilet paper holder device primarily comprised of at least two side walls, at least one bottom wall, at least one base and at least one toilet paper roll holder. The toilet paper roll holder is spring-loaded such that a toilet paper roll can be secured between the side walls of the device. The side walls and bottom wall further attach to the base via at least one fastener that allows the side walls and bottom wall to rotate around the base. Therefore, a toilet paper roll that is secured between the side walls via the toilet paper roll holder can be easily rotated about the base such that the toilet paper within the device can be positioned so that toilet paper can be pulled from over top or from under the toilet paper roll. Accordingly, the present disclosure makes specific reference thereto. Nonetheless, it is to be appreciated that aspects of the present invention are also equally applicable to other like applications, devices and methods of manufacture.

BACKGROUND

Households with multiple individuals may have differing opinions or preferences on the direction that a toilet paper roll should be placed on a toilet paper holder. Some individuals may prefer pulling toilet paper from under the roll, while others may prefer to pull the toilet paper from over the roll. However, if one individual positions a toilet paper roll on a toilet paper holder such that the paper can only be pulled from under the roll, another individual who prefers to pull the paper from over the roll must completely remove, reposition and then replace the toilet paper back onto the toilet paper holder such that the toiler paper is in their preferred position. This is undesirable, as it is unnecessary and inefficient.

Therefore, there exists a long-felt need in the art for a device that eliminates the need to reposition toilet paper on a toilet paper holder. There also exists a long-felt need in the art for a rotatable toilet paper holder device that can be rotated. Further, there exists a long-felt need in the art for a rotatable toilet paper holder device that can be rotated to allow multiple users to place a toilet paper roll in their preferred orientation, and wherein the device does not require that a user removes the toilet paper from the device to do so.

The subject matter disclosed and claimed herein, in one embodiment thereof, comprises a rotatable toilet paper holder device. The device is primarily comprised of at least two side walls, at least one bottom wall, at least one base, and at least one toilet paper roll holder. The toiler paper roll holder is spring-loaded such that a toilet paper roll can be secured between the side walls of the device. The side walls and bottom wall further attach to the base via at least one fastener that allows the side walls and bottom wall to rotate around the base. Therefore, a toilet paper roll that is secured between the side walls via the toilet paper roll holder can be easily rotated about the base such that the toilet paper within the device can be positioned so that toilet paper can be pulled from over top or from under the toilet paper roll.

In this manner, the rotatable toilet paper holder device of the present invention accomplishes all of the forgoing objectives and provides a device that eliminates the need to reposition toilet paper on a toilet paper holder. During use, the device can be rotated to allow multiple users to place a toilet paper roll in their preferred orientation. However, the device does not require that a user removes the toilet paper from the device to do so.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a rotatable toilet paper holder device. The device is primarily comprised of at least two side walls, at least one bottom wall, at least one base and at least one toilet paper roll holder. In the preferred embodiment of the device, the device is manufactured from a durable metal, wood material, or rigid plastic. The device may further be any color in the art and may be transparent, semi-transparent or opaque. In addition, the device may be comprised of a plurality of indicia such as, but not limited to, patterns, logos, emblems, images, symbols, designs, letters, numbers, words, characters, animals, advertisements, brands, etc.

The at least two side walls of the device are preferably generally rectangular in shape and are preferably connected to at least one bottom wall, each at a 90-degree angle, by at least one fastener. The bottom wall is further preferably generally rectangular in shape and has at least one continuous opening that receives at least one fastener that is fixedly or removably attached to the top surface of the base. In the preferred embodiment, the fastener is a pivot pin that allows the bottom wall to rotate 360-degrees around the fastener and base. Further, the fastener may have integral locking positions every 360 or 180 degrees that can be used to quickly rotate the device in order to position a toilet paper roll such that the toilet paper is positioned so that it can be pulled from under the roll or from over the roll. In this manner, the device can be rotated 360-degrees, but would automatically lock into position once a rotation has been completed.

The base is further preferably generally rectangular in shape and has at least one continuous opening that allows at least one fastener to be used to fasten the base to a wall surface. Alternatively, the rear surface of the base may be magnetized or have an adhesive coating to allow it to adhere to a wall surface.

The toilet paper holder has a first cylindrical member and a second cylindrical member that sits within the first cylindrical member, wherein the holder has at least one internal spring. In this manner, the holder is spring-loaded such that the holder can be placed through the opening of a toilet paper roll and the roll and holder can be pressed against the interior surfaces of both sidewalls of the device. As a result, the holder secures a toilet paper roll within the device.

Accordingly, the rotatable toilet paper holder device of the present invention is particularly advantageous as it eliminates the need to reposition toilet paper on a toilet paper holder by being capable of being rotated to allow multiple users to place a toilet paper roll in their preferred orientation. In doing so, the device does not require that a user removes the toilet paper from the device to do so. In this manner, the rotatable toilet paper holder device overcomes the limitations of existing toilet paper holders known in the art.

To the accomplishment of the foregoing and related ends, certain illustrative aspects of the disclosed innovation are described herein in connection with the following description and the annexed drawings. These aspects are indicative, however of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
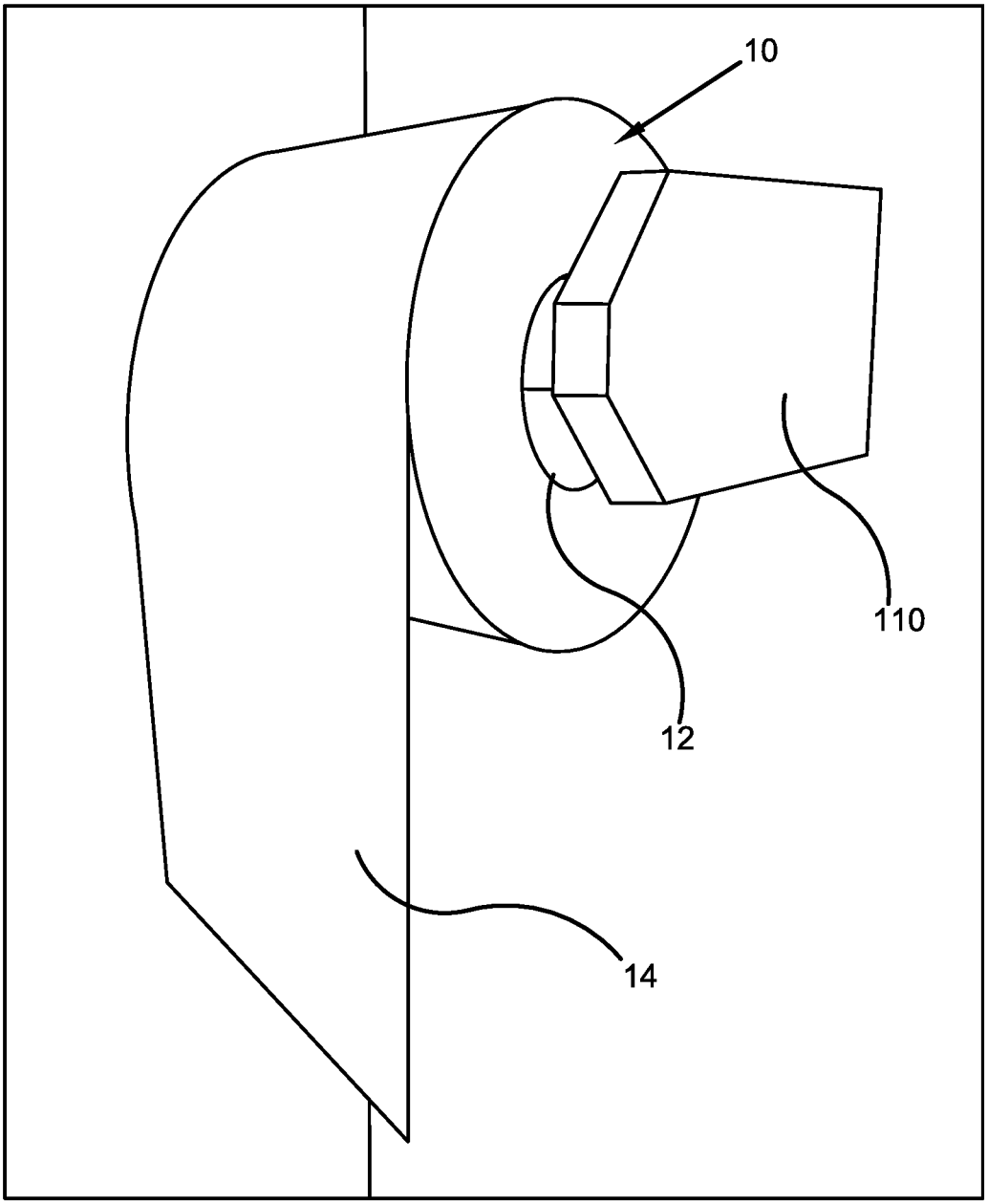
FIG. 1 illustrates a perspective view of one potential embodiment of a rotatable toilet paper holder device of the present invention while attached to a wall in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a device that eliminates the need to reposition toilet paper on a toilet paper holder. There also exists a long-felt need in the art for a rotatable toilet paper holder device that can be rotated. Further, there exists a long-felt need in the art for a rotatable toilet paper holder device that can be rotated to allow multiple users to place a toilet paper roll in their preferred orientation, and wherein the device does not require that a user removes the toilet paper from the device to do so.

The present invention, in one exemplary embodiment, is comprised of a rotatable toilet paper holder device primarily comprised of at least two side walls, at least one bottom wall, at least one base, and at least one toilet paper roll holder. In the preferred embodiment of the device, the device is manufactured from a durable metal, wood material or rigid plastic and may be any color in the art and may be transparent, semi-transparent or opaque. In addition, the device may be comprised of a plurality of indicia such as, but not limited to, patterns, logos, emblems, images, symbols, designs, letters, numbers, words, characters, animals, advertisements, brands, etc.

The at least two side walls of the device are preferably generally rectangular in shape and are preferably connected to at least one bottom wall, each at a 90-degree angle, by at least one fastener. The bottom wall is further preferably generally rectangular in shape and has at least one continuous opening that receives at least one fastener that is fixedly or removably attached to the top surface of the base. In the preferred embodiment, the fastener is a pivot pin that allows the bottom wall to rotate 360-degrees around the fastener and base and wherein the fastener may have integral locking positions every 360 or 180 degrees that can be used to quickly rotate the device in order to position a toilet paper roll such that the toilet paper is positioned such that it can be pulled from under the roll or from over the roll. In this manner, the device can be rotated 180 or 360 degrees, but would automatically lock into position once a rotation has been completed.

The base is further preferably generally rectangular in shape and has at least one continuous opening that allows at least one fastener to be used to fasten the base to a wall surface. Alternatively, the rear surface of the base may be magnetized or have an adhesive coating to allow it to adhere to a wall surface.

The device is further comprised of a toilet paper roll holder. The holder has a first cylindrical member and a second cylindrical member that sits within the first cylindrical member, wherein the holder has at least one internal spring. In this manner, the holder is spring-loaded such that the holder can be placed through the opening of a toilet paper roll and the roll and holder can be pressed again the interior surfaces of both sidewalls of the device. In this manner, the holder secures a toilet paper roll within the device.

Accordingly, the rotatable toilet paper holder device of the present invention is particularly advantageous as it eliminates the need to reposition toilet paper on a toilet paper holder by being capable of being rotated to allow multiple users to place a toilet paper roll in their preferred orientation. In doing so, the device does not require that a user removes the toilet paper from the device to do so. In this manner, the rotatable toilet paper holder device overcomes the limitations of existing toilet paper holders known in the art.

Referring initially to the drawings, FIG. 1 illustrates a perspective view of one potential embodiment of a rotatable toilet paper holder device 100 of the present invention while attached to a wall 20 in accordance with the disclosed architecture. The device 100 is primarily comprised of at least two side walls 110, at least one bottom wall 120, at least one base 140, and at least one toilet paper roll holder 160. In the preferred embodiment of the device 100, the device 100 is manufactured from a durable metal such as, but not limited to, stainless steel or aluminum, any wood material known in the art, or a rigid plastic such as, but not limited to, an acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, recycled plastic, biodegradable plastic, etc. In differing embodiments, the device 100 may further be any color in the art and may be transparent, semi-transparent or opaque. In addition, the device 100 may be comprised of a plurality of indicia 170 such as, but not limited to, patterns, logos, emblems, images, symbols, designs, letters, numbers, words, characters, animals, advertisements, brands, etc.

The at least two side walls 110 of the device 100 are preferably generally rectangular in shape and are preferably generally parallel. However, the side walls 110 may be any shape known in the art such as, but not limited to, square, triangular, circular, etc., in differing embodiments. Further, the edges 112 of the side walls 110 may further be rounded, chamfered, angled, etc. Both side walls 110 are preferably connected to at least one bottom wall 120, each at a 90-degree angle, by at least one fastener 150. In differing embodiments, the fastener 150 may be any fastener 150 known in the art such as, but not limited to: screw, nail, magnet, hook and loop, adhesive, etc.

Figure 2:
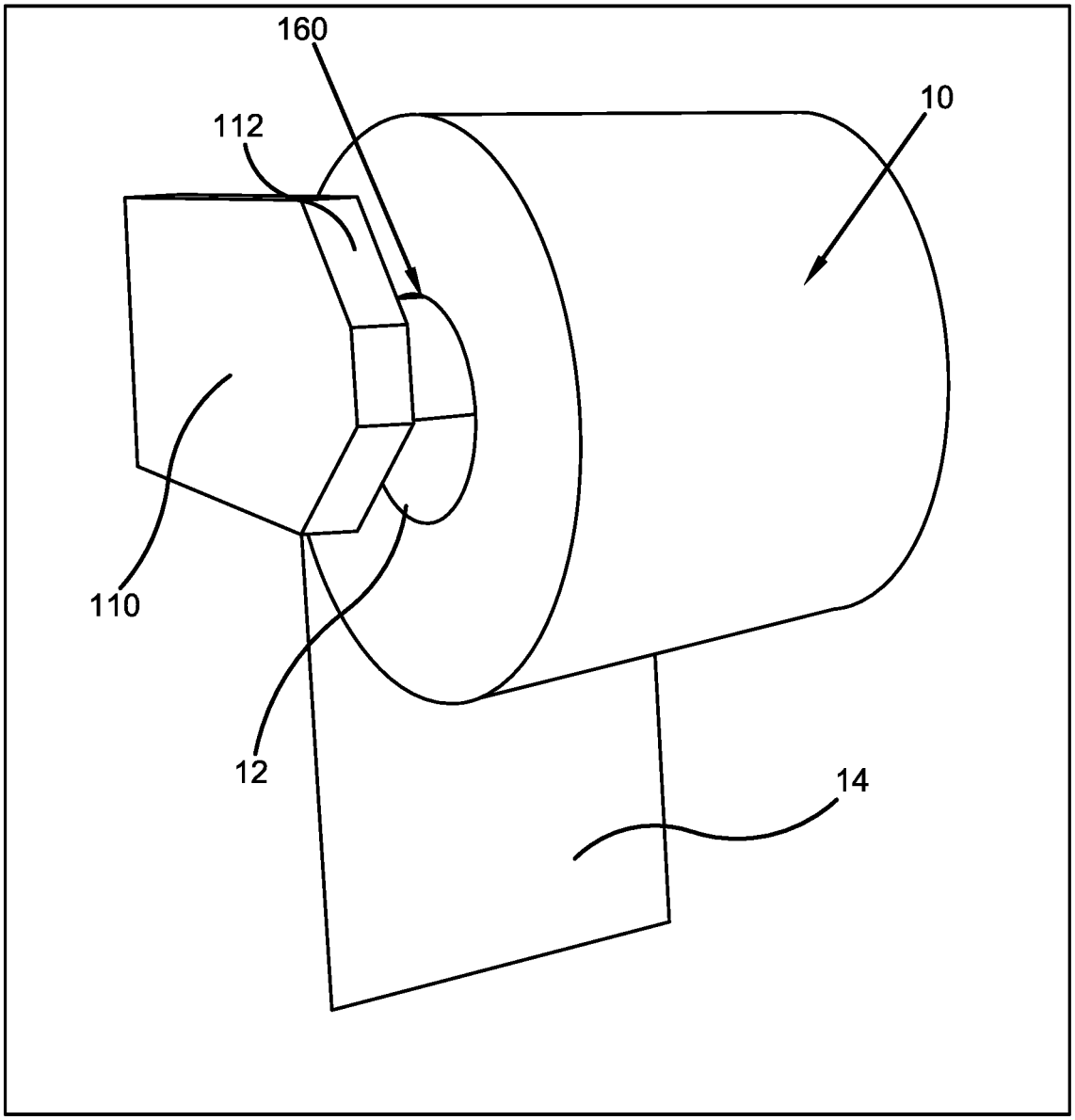
FIG. 2 illustrates a perspective view of one potential embodiment of a rotatable toilet paper holder device of the present invention while attached to a wall in accordance with the disclosed architecture.
Figure 3:
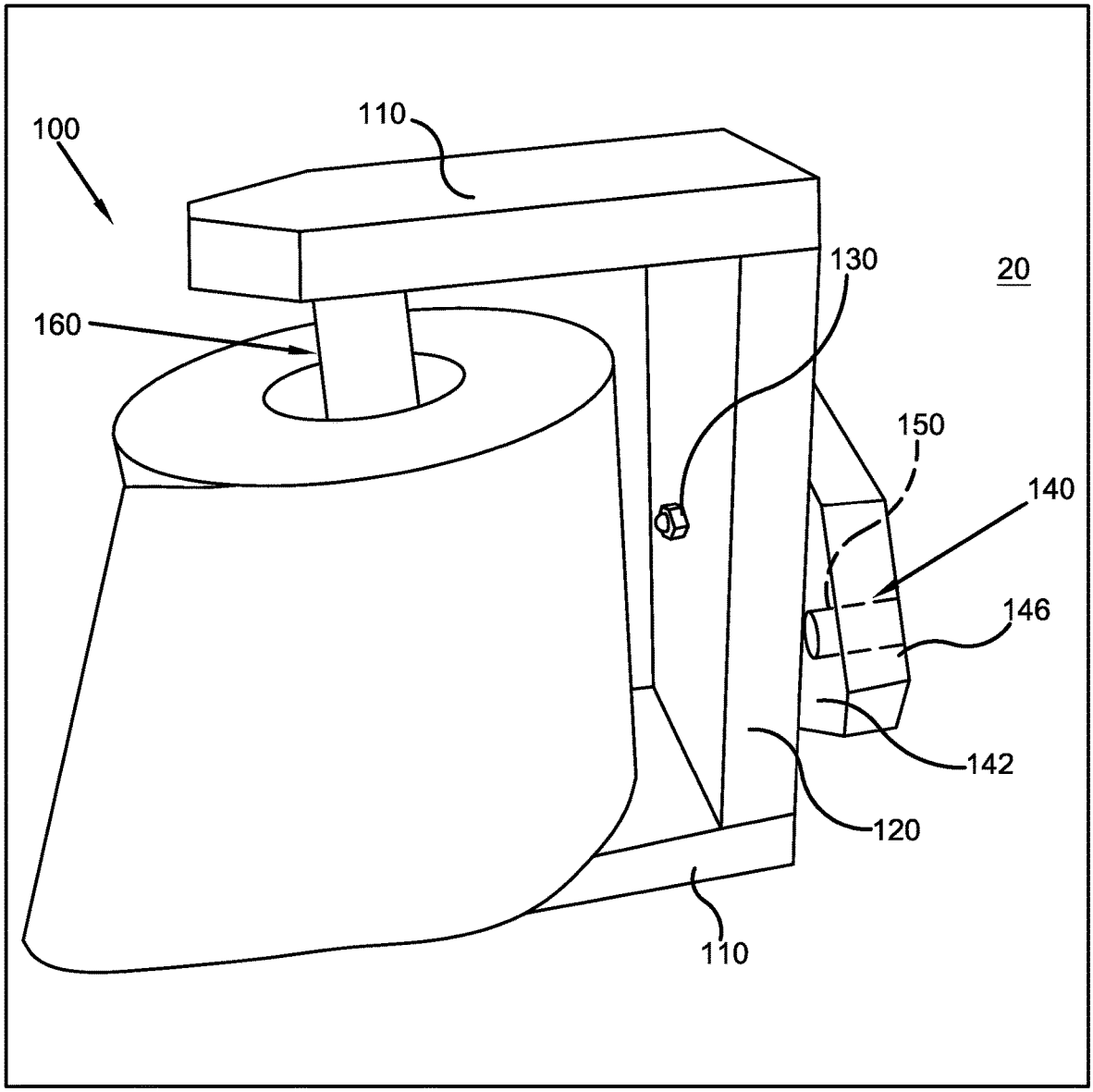
FIG. 3 illustrates a perspective view of one potential embodiment of a rotatable toilet paper holder device of the present invention while attached to a wall and while being rotated in accordance with the disclosed architecture.

FIG. 3 illustrates a perspective view of one potential embodiment of a rotatable toilet paper holder device 100 of the present invention while attached to a wall 20 and while being rotated in accordance with the disclosed architecture. The bottom wall 120 is further preferably generally rectangular in shape. However, the bottom wall 120 may be any shape known in the art such as, but not limited to: square, triangular, circular, etc. The bottom wall 120 further has at least one continuous opening 122. The opening 122 receives at least one fastener 130 that is fixedly or removably attached to the top surface 142 of the base 140. In the preferred embodiment, the fastener 130 is a pivot pin or a detent pin that allows the bottom wall 120 to rotate 360-degrees around the fastener 130 and base 140. However, in differing embodiments the fastener 130 may be fasteners such as, but not limited to, a screw, a nail, a bearing, a roller, etc. Further, the fastener 130 may have integral locking positions every 180 or 360 degrees (in either clockwise or counter clockwise directions) that can be used to quickly rotate the device 100 (i.e., rotate the bottom wall 120 and side walls 110 around the base 140) in order to position a toilet paper roll 10 such that the toilet paper 14 is positioned so that it can be pulled from under the roll 10 (as seen in FIG. 2) or from over the roll 10 (as seen in FIG. 1). In this manner, the device 100 can be rotated 360-degrees, but would automatically lock into position once a 360 rotation has been completed.

The base 140 is further preferably generally rectangular in shape. However, the base 140 may be any shape known in the art such as, but not limited to, square, triangular, circular, etc. The base 140 preferably has at least one continuous opening 144 that allows at least one fastener 150 such as, but not limited to, a screw, a nail, a bolt, etc. to be used to fasten the base 140 to a wall surface 20. Alternatively, the rear surface 146 of the base 140 may be magnetized or have an adhesive coating to allow it to adhere to a wall surface 20.

Figure 4:
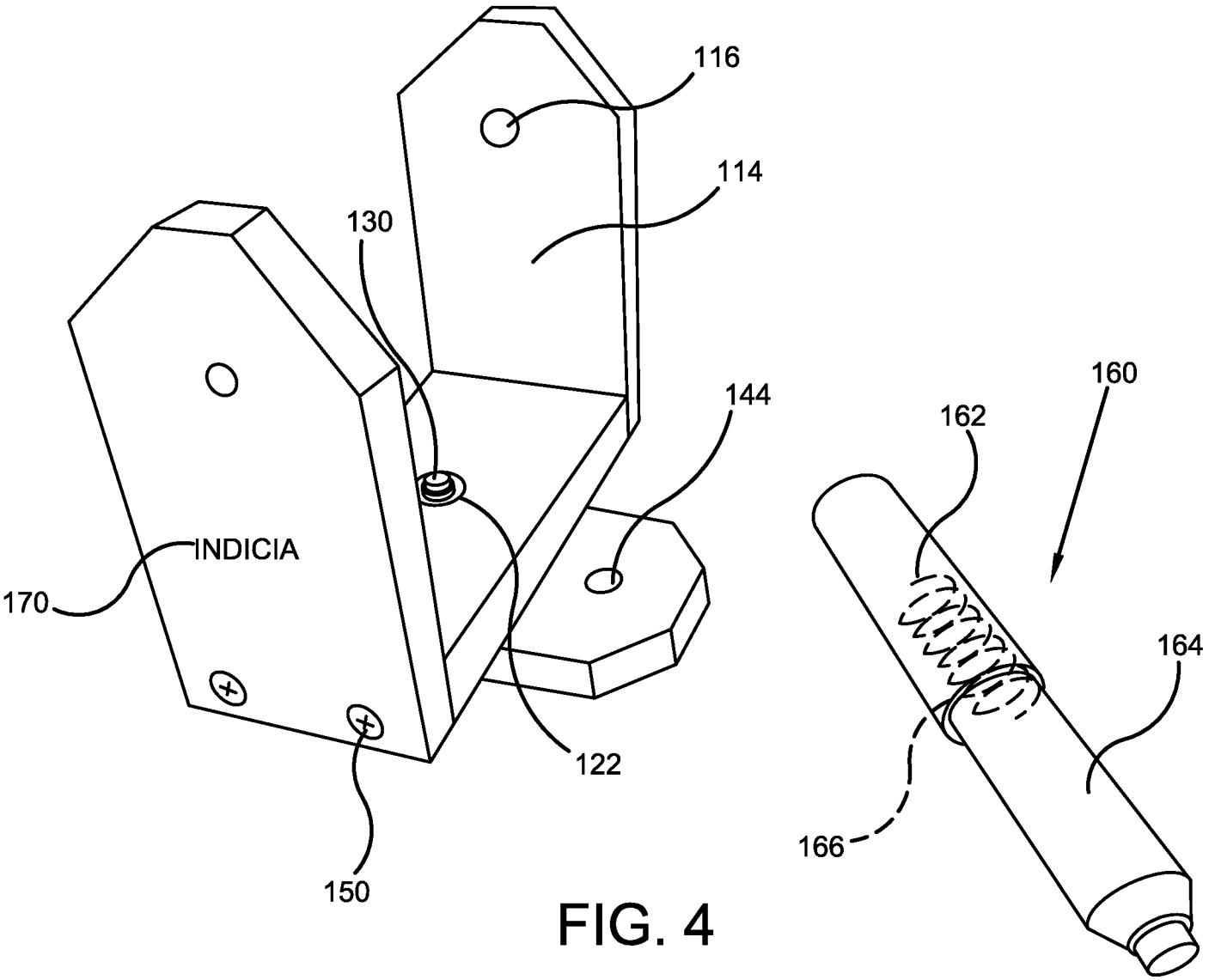
FIG. 4 illustrates a perspective view of one potential embodiment of a rotatable toilet paper holder device of the present invention in accordance with the disclosed architecture.

FIG. 4 illustrates a perspective view of one potential embodiment of a rotatable toilet paper holder device 100 of the present invention in accordance with the disclosed architecture. The device 100 is further comprised of a toilet paper roll holder 160. The holder 160 is comprised of a first cylindrical member 162 and a second cylindrical member 164 that sits within the first cylindrical member 162, wherein the holder 160 has at least one internal spring 166. In this manner, the holder 160 is spring-loaded such that the holder can be placed through the opening 12 of a toilet paper roll 10. Then, the second member 164 can be pressed against the interior surface 114 of one side wall 110, such that the first member 162 retracts within the second member 164. Then, the entire roll 10 can be placed between both sidewalls 110 and the holder 160 can be released. Releasing the holder 160 allows the spring 166 to expand, which then causes the first member 162 to press against the interior surface 114 of the other sidewall 110 (i.e., the side wall that the second member 164 is not contacting. In this manner, the roll 10 is removably secured between the sidewalls 110. In order to better secure the holder 160, the interior surface 114 of each sidewall 110 may further be comprised of at least one channel or indentation 116 that the first member 162 and second member 164 may sit within.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "rotatable toilet paper holder device" and "device" are interchangeable and refer to the rotatable toilet paper holder device 100 of the present invention.

Notwithstanding the forgoing, the rotatable toilet paper holder device 100 of the present invention and its various components can be of any suitable size and configuration as is known in the art without affecting the overall concept of the invention, provided that they accomplish the above-stated objectives. One of ordinary skill in the art will appreciate that the size, configuration and material of the rotatable toilet paper holder device 100 as shown in the FIGS. are for illustrative purposes only, and that many other sizes and shapes of the rotatable toilet paper holder device 100 are well within the scope of the present disclosure. Although the dimensions of the rotatable toilet paper holder device 100 are important design parameters for user convenience, the rotatable toilet paper holder device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A rotatable toilet paper holder device comprising:

a side wall;

a bottom wall;

a base;

a fastener; and a toilet paper roll holder; and wherein the fastener is configured to lock the bottom wall in position at 180 and 360 degree positions with respect to the base.

2. The rotatable toilet paper holder device of claim 1, wherein the toilet paper roll holder comprises an internal spring.

3. The rotatable toilet paper holder device of claim 1, wherein the fastener is attached to the base and to the bottom wall.

4. The rotatable toilet paper holder device of claim 3, wherein the side wall and the bottom wall are rotatable about the base via the fastener.

* * * * *